United States Patent [19]

Beattie et al.

[11] Patent Number: 4,846,066

[45] Date of Patent: Jul. 11, 1989

[54] DETONATOR SYSTEM

[75] Inventors: Timothy A. Beattie, Blackburn; Barry K. Miskin, West Essendon, both of Australia

[73] Assignee: ICI Australia Operations Proprietary Limited, Victoria, Australia

[21] Appl. No.: 90,340

[22] Filed: Aug. 28, 1987

[30] Foreign Application Priority Data

Aug. 29, 1986 [AU] Australia ..... PH7726

[51] Int. Cl.[4] ..... F23Q 7/02

[52] U.S. Cl. ..... 102/215; 102/217

[58] Field of Search ..... 102/200, 206, 215, 217

[56] References Cited

U.S. PATENT DOCUMENTS

| | | | |
|---|---|---|---|
| 821,883 | 5/1906 | DuPont | 108/206 |
| 4,324,182 | 4/1982 | Kirby et al. | 102/217 |
| 4,646,640 | 3/1987 | Florin et al. | 102/217 |

FOREIGN PATENT DOCUMENTS

| | | | |
|---|---|---|---|
| 3336534 | 4/1985 | Fed. Rep. of Germany | 102/206 |
| 8367 | 11/1973 | South Africa | 102/217 |
| 8368 | 11/1973 | South Africa | 102/217 |

*Primary Examiner*—Deborah L. Kyle
*Assistant Examiner*—Richard W. Wendtland
*Attorney, Agent, or Firm*—Cushman, Darby & Cushman

[57] ABSTRACT

An apparatus for blasting comprises a series of electronically programmable detonators and an exploder, connected in series. The exploder communicates to the detonators at least programming and firing signals. The detonators are connected in such a way that programming signals will be received by a given detonator only when the adjacent detonator nearer to the signal output of the exploder has been programmed. This is preferably achieved by use of a connector associated with each detonator, the connector comprising a switching device which is operated by a logic element such that the logic element will operate on the switching device and allow signals to pass only when the detonator associated with that connector has been programmed.

The apparatus permits the versatile and precise use of explosives, especially where large numbers of charges are involved.

7 Claims, 1 Drawing Sheet

DETONATOR SYSTEM

This invention relates to the blasting of rock and ore and more particularly to an apparatus for blasting.

Large-scale blasting of rock and ore involving a large number of explosive charges is a skilled art in that the size of the charges and the order and timing of their detonation must be precisely controlled. The timing of any given detonation is achieved by a combination of timing of firing signal and the delay built into the detonator which detonates the charge. In the past, the delays have bee pyrotechnic, that is, they comprise a combustible chemical fuse which on receiving a firing signal takes a finite time to burn down and set off the charge. The time scatter inherent in pyrotechnic delays of the same delay time has meant an increase in interest in electronic detonators where much more precise timing is possible. In addition, it is possible to make such detonators programmable such that the programming and firing instructions can be communicated to the detonator when it is in place. This has the major advantages that (a) only a single detonator type need be kept rather than the considerable inventory previously necessary, and (b) the blast pattern can be set or changed at any time between loading and detonation.

In spite of the versatility introduced by programmable electronic detonators, there remain problems with large-scale blasts. One of these is the complexity of the wiring required to communicate with all of the detonators. One of the most common ways of communicating firing instructions is by means of a multi-channel exploder (MCE), a device which can trigger a number of detonations at specified delays. However, when the blast pattern is large, the wiring can become very complex, with MCEs operating other MCEs, and it is often very difficult or even impossible to achieve the detonation delays and pattern which give the most efficient use of explosive.

We have now found that by using a particular combination of elements, the previous difficulties of wiring large blast patterns can be substantially overcome. We therefore provide, according to the present invention, an apparatus for blasting, the apparatus comprising a plurality of detonators and an exploder, connected in series, the individual detonators having delays which are electronically programmable and the exploder communicating to the detonators at least programming and firing signals, the detonators being connected such that programming signals will be received by a given detonator only when the delay of the adjacent detonator nearer to the signal output of the exploder has been programmed.

We also provide a method of detonating a plurality of explosive charges in a predetermined pattern and at predetermined time intervals, the charges being detonated by detonators each of which is individually programmable in respect of delay time and each of which received at least its programming and firing signals from an exploder device to which all detonators are connected in series, each detonator being connected such that it will receive programming signals only when the delay of the adjacent detonator nearer to the signal output of the exploder has been programmed. The apparatus of our invention permits of considerable versatility in the firing of large blast patterns. In contrast to the method currently used by the art and which employ parallel wiring of great complexity, a single length of communications wiring will serve the entire pattern. The invention permits the versatility of programmable detonators to be fully realised.

The detonators for use in this invention may be any type of detonator known to the art which are suitable for use in conjunction with electronic delays. It is permissible to include pyrotechnic delays in the system, but the scatter inherent in the delay times of such delays appreciably reduces the precision made possibly by the use of electronics. We therefore use detonators in which are incorporated programmable delays, or non-delay or fixed delay types to which suitable programmable electronic delay circuitry can be appended. The power to make the detonators function may be provided by any convenient means known to the art, for example, by batteries located within or near the detonators, by solar cells at the surface or by power sent from the exploder and retained in a capacitor.

The exploder may be any device capable of sending a series of electronic signals. It may be, for example, a suitably modified microcomputer. A preferred exploder comprises a keypad for loading delay times, a display for verification, a security mechanism for the prevention of unauthorised use and a means for resetting after an aborted firing. Other features can add considerably to the versatility of the system. For example, in one embodiment the keypad is detachable from the exploder and may be directly coupled to the detonator for the input of information. This can be done either prior to or after loading the detonator. The information is stored on a microprocessor associated with the keypad and can be passed on to the exploder when the keypad is plugged back into it. The provision of all of these features is well within the skill of the art.

The communications wire which joins the detonators and the exploder device in series may be any suitable wire known to the art to be suitable for use with electronic detonators. It may be, for example, a three core wire having a power line, a communication line and an earth. Another option is a two core wire wherein a single line carries both communications and power. Individual lengths of individual detonators, but it is much easier and preferable to use a single length of wire (known as a "bus" wire) to which the detonator can readily be attached. An essential feature of the invention is the connection of the detonators or groups of detonators such that any given detonator will not receive delay programming instructions until the detonator preceding it in the series connection, that is, the one nearer to the signal output of the exploder, has received and stored its programming instructions. This is achieved by electrical means which may be built into or appendable to a detonator, but which preferably is incorporated into a connector which makes the series connection between the detonator and the adjacent detonators or the adjacent detonator and the exploder. A typical format will comprise a switching device, such as a relay, which is acted upon by a logic element, the series connection running through the switching device. Only when a delay time has been received and stored will the logic element act to close the switch and permit the programming signals to reach the next detonator in line.

The invention will now be further described by reference to the drawings which depict a preferred embodiment.

Figure 1:
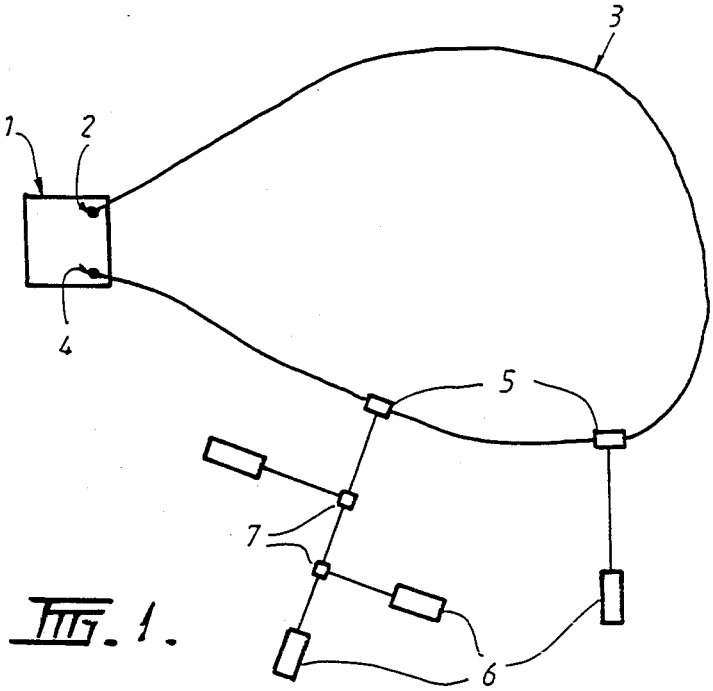
FIG. 1 depicts a schematic layout of an apparatus for blasting according to the invention.

An exploder 1 has two terminals, 2 and 4, which are joined by a continuous bus wire 3. To this bus wire are attached detonators 6 by means of connectors 5. A connector can service a single detonator or a group of detonators, these being connected to the connector 5 and therefore to the bus wire by connectors 7.

Figure 2:
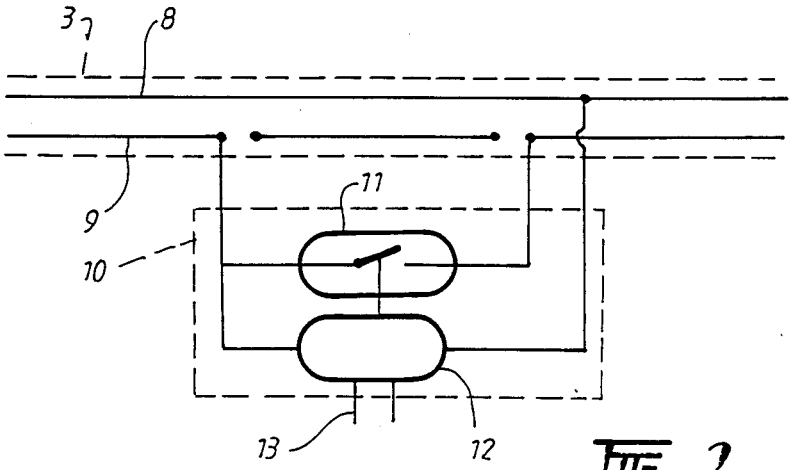
FIG. 2 depicts schematically a connector by which a detonator is linked to an exploder and which permits the passage of programming signals when a detonator associated therewith has been programmed.

The circuitry of the connector 5 is shown in more detail in FIG. 2. The bus wire 3 comprises two lines, an earth wire 8 and a power/communications wire 9. The power/communications wire is discontinuous, being broken at the connector and rerouted through a circuit 10 which comprises a relay-operated switch 11 and a logic element 12. Prior to a signal receipt the switch is in the "off" position; any signals coming along the power/communications wire will thus stop at this point. The logic element 12 is connected to the power/communications wire on that side of the switch which receives the incoming signal. It is also connected to the earth wire, to the detonator by wire 13, and to the switch such that it can change the state of the relay and close the switch.

In operation, programming signals arrive from the exploder via the power/communications wire 9 and are prevented from going further by the switch 11. The signals are then passed on to the programmable delay element in the detonator and when these have been received, stored and verified, the logic element 12 actuates the relay, closing the switch and permitting programming signals to pass to the next detonator. When all programming signals for all detonators have been sent, the exploder sends a final signal which should be received at terminal 4. If no such signal arrives at 4, or if the exploder receives a signal out of sequence, an error condition is indicated and firing is disabled. If the final signal is received, firing is enabled and is brought about by the issuing of "arm" and "fire" signals. The hardware used in the performance of this invention is either readily available to the person skilled in the art, or could be easily constructed. The connector 5 may be fabricated with quick-acting, insulation-piercing components which allow its easy attachment to bus wires. Other variations will be obvious to the skilled person. For example, the detonator may have a fixed delay and a variable delay may be incorporated into the logic element of the connector.

The invention permits the use of detonators with degrees of precision, safety and ease of installation and use not previously attainable in commercial blasting.

We claim:

1. A method of detonating a plurality of explosive charges in a predetermined pattern and at predetermined time intervals, the charges being detonated by detonators each of which is individually programmable in respect to delay time and each of which received at least its programming and firing signals from an exploder device to which all detonators are connected, each detonator being connected such that it will receive programming signals only when the delay of the adjacent detonator nearer to the signal output of the exploder has been programmed but such that the firing signal is given simultaneously to the thus programmed detonators.

2. A method according to claim 1, wherein the detonators and the exploder are connected by means of a single continuous bus wire.

3. A method according to claim 1 wherein the connection of the detonators and exploder is effected by means of connectors each of which comprises a switching device which is operated by a logic element such that the logic element will cause the switching device to operate only when the detonator asociated with the connector has received and stored its delay information.

4. An apparatus for blasting, the apparatus comprising a plurality of detonators and an exploder, the individual detonators having delays which are electronically programmable and the exploder communicating to the detonators at least programming and firing signals, the detonators being connected such that programming signals will be received by a given detonator only when the delay of the adjacent detonator nearer to the signal output of the exploder has been programmed and means for simultaneously providing all of the detonators with a firing signal so that the detonators function as programmed.

5. An apparatus for blasting according to claim 4, wherein the detonators and the exploder are connected by means of a single continuous bus wire.

6. An apparatus for blasting according to claim 4 wherein the connection of the detonators and exploder is effected by means of connectors each of which comprises a switching device which is operated by a logic element such that the logic element will cause the switching device to operate only when the detonator associated with the connector has received and stored its delay information.

7. A connector for use in association with an electronically programmable detonator in an apparatus for blasting according to claim 4, the connector comprising a logic element and a switching device, the logic element acting on the switching device so as to permit the passage of signals to a neighbouring connector to which it is attached in series only when the detonator associated with the first-mentioned connector has been programmed.

* * * * *